US005850696A

United States Patent [19]

Sciarrone

[11] Patent Number: 5,850,696

[45] Date of Patent: Dec. 22, 1998

[54] CHAIN SAW GUARD

[76] Inventor: Angelo Sciarrone, 7883 Lake Pleasant Rd., Erie, Pa. 16509

[21] Appl. No.: 924,175

[22] Filed: Sep. 5, 1997

Related U.S. Application Data

[60] Provisional application No. 60/025,687 Sep. 9, 1996.

[51] Int. Cl.[6] ..... B27B 17/02

[52] U.S. Cl. ..... 30/382; 30/371

[58] Field of Search ..... 30/371, 381, 382, 30/166.3

[56] References Cited

U.S. PATENT DOCUMENTS

| | | | |
|---|---|---|---|
| 3,327,743 | 6/1967 | Long et al. | 30/382 |
| 3,384,136 | 5/1968 | Marin et al. | 30/382 |
| 3,636,996 | 1/1972 | Lanz | 30/382 |
| 4,143,460 | 3/1979 | Shean | 30/382 |
| 4,257,162 | 3/1981 | Pardon | 30/382 |
| 4,447,953 | 5/1984 | Lombardino et al. | 30/382 |
| 4,841,641 | 6/1989 | Laidlaw | 30/382 |
| 4,945,641 | 8/1990 | Miller et al. | 30/382 |
| 4,991,297 | 2/1991 | Cain | 30/382 |
| 5,179,785 | 1/1993 | Nagashima | 30/382 |

FOREIGN PATENT DOCUMENTS

| | | | |
|---|---|---|---|
| 746304 | 11/1966 | Canada | 30/382 |

*Primary Examiner*—Hwei-Siu Payer
*Attorney, Agent, or Firm*—Lovercheck and Lovercheck

[57] ABSTRACT

A chain saw having a guard member supported above the chain of the saw. The guard is supported by support members at the first and second ends of the chain guide. At the first end of the chain guide the blade is swingably supported and is swingable through a range from a position parallel to the chain guide to a position normal to the chain guide. At the second end of the chain guide the guard bar is releasably supported to hold the guard bar in a guard position parallel to the chain guide and to release the guard bar to swing out of the way when a work piece is being cut.

20 Claims, 3 Drawing Sheets

CHAIN SAW GUARD

BACKGROUND OF THE INVENTION

This application claims the benefit of U.S. provisional application Ser. No. 60/025,687, filed Sep. 9, 1996.

This invention relates to guards for chain saws and more particularly to a chain saw guard which is releasably attached above the chain of a chain saw in a position to prevent injury to the chain saw operator in the event of a fall by the operator or a kickback by the chain saw itself.

A number of devices are known which either surround or cover the guide bar on a chain saw to prevent contact between the saw chain and the user in the event of chain saw kickback. In order for the saw to continue to have full utility, such guards must allow the saw to pass through the material which is intended to be cut while providing minimal interference with the cutting operation. To this end, a variety of springs, levers and guard configurations have been proposed. While the devices may be useful, they tend to limit the utility of the chain saw because of the complexity of the mounting mechanism and the guard devices.

Applicant is aware of the following U.S. Pat. Nos.: 4,143,460; 4,447,953; 4,841,641; 4,945,641; 4,991,297; and, 5,179,785. Each of these patents discloses a guard for a chain saw but none of them discloses a bar above the chain that is rotatably supported at one end and releasably supported above the chain at the other end.

SUMMARY OF THE INVENTION

Chain saw guards are known, but there is a need for a chain saw guard that does not limit the utility of the saw and is simple in construction, economical to manufacture and is simple and efficient to use. Applicant has provided a chain saw guard that requires an extremely simple hinge connection to the chain saw blade and a simple latch to hold the guard in place during use. There are minimal parts to hold and it is rigid, durable and efficient.

The chain saw guard is intended for use on an ordinary chain saw which includes an engine, a fixed blade or chain guide extending outwardly from the engine, a frame supporting the engine and the fixed blade, and a chain with cutting teeth outwardly disposed thereon.

The guard includes a sturdy bar that is supported above and adjacent to the chain. The bar is swingably fixed at its end adjacent the frame. A support is fixed to the proximal end of the blade and rotatably supports the guard at a predetermined height above the chain. At the distal end of the blade, a second support is attached to the blade. The support extends above the chain and releasably secures the guard bar in a position immediately above the chain. When cutting through a workpiece, such as a log, the bar is released and swings upwardly out of the way. After the cut is completed, the bar swings back to the support and may be secured in the guard position.

The chain saw guard structure at the distal end may include a single rigid member fixed by bolts or other appropriate fasteners to the nose cover. The nose cover is provided to prevent the user from cutting with the chain at the distal end of the chain guide. The rigid member extends to a point above the chain. Two flexible members are attached to the upper end of the rigid member and are shaped to receive the guard bar adjacent its distal end. The flexible members retain the guard bar above the chain in a guard position. The flexible members release the guard bar when the chain saw to be operated to allow the saw to pass through the workpiece to complete the cut.

In another embodiment of the invention, the chain saw guard may include two spaced rigid plates with a bolt extending through them to hold the two plates to the inner or proximal end of the chain guide member forming a hinge.

A round tubular member is received between the upper end or distal ends of the two plates and is swingably attached to them by a bolt. The distal end of the tube may be retained between two spaced spring plates that are bolted to the distal end of the chain guide member by a bolt or other suitable fastener. The distal end of the guard bar swings down between the two plates and is retained in the shaped ends of the spring plates. The tension of the spaced spring plates is adjustable by means of a threaded screw, for example, to adjust the force required to force the distal end of the tube into secured position engaged by the spring plates and the force required to release the tube from the secured position In another embodiment, one spring plate is secured to the distal end of the guide bar having its upper end shaped to retain the guard bar in a guard position. The single spring plate engages and releases the guard bar in a manner of operation similar to the two spring plate embodiment.

It is an object of the present invention to provide a chain saw guard that will protect persons from injury while carrying or using the chain saw.

It is another object of the present invention to provide a chain saw guard which can be swung out of its guard position during use of the chain saw and which can be returned to its guard position when the saw is not in use.

It is another object of the present invention to provide a chain saw guard that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
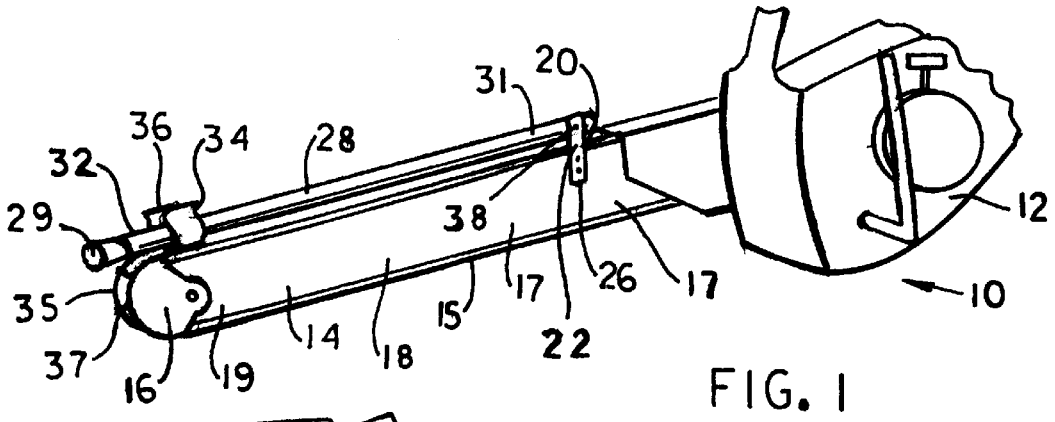
FIG. 1 is an isometric view of the chain saw with the guard in guard position according to the invention.
Figure 2:
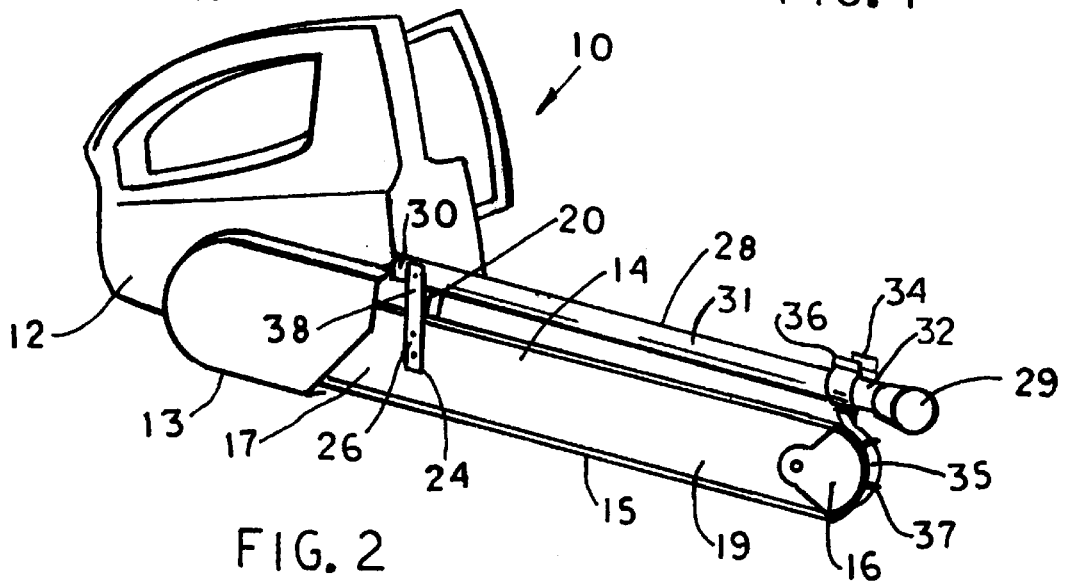
FIG. 2 is an isometric view of the chain saw with the guard in guard position viewed from an opposite side as shown in FIG. 1.
Figure 3:
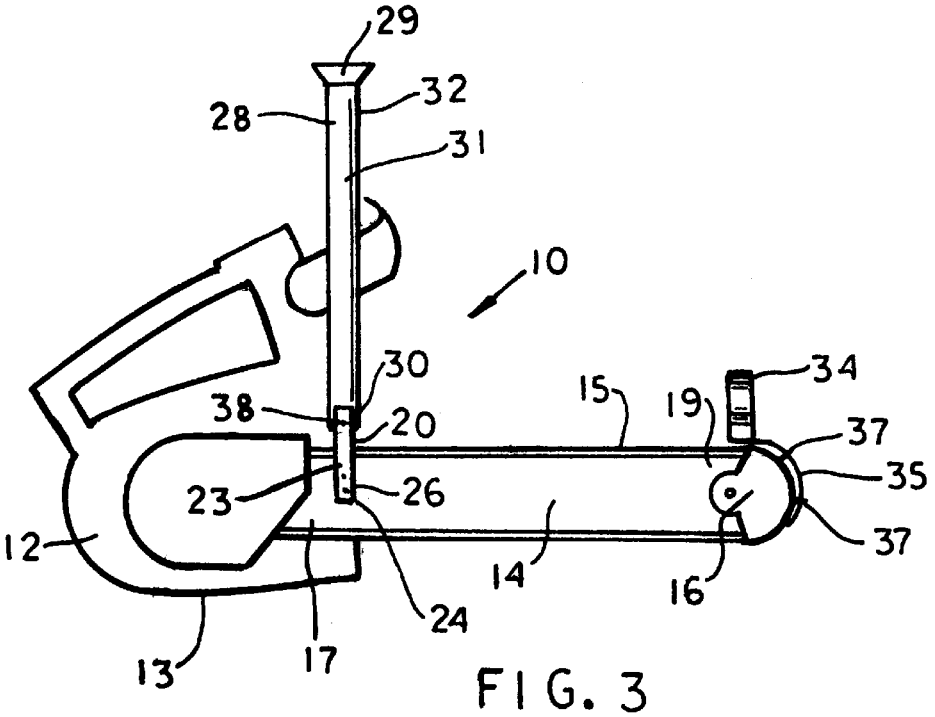
FIG. 3 is a side view of the invention with the chain saw guard in a use position swung away from the saw blade.

Now with more particular reference to the drawings, FIGS. 1 through 3 show chain saw 10 with guard 28 according to the invention. The chain saw has frame 13. Frame 13 has chain saw engine 12 attached thereto of a conventional type that may be a gasoline driven engine or an electric powered motor. Chain saw frame 13 has blade or chain guide 14 attached thereto at its first end 17. Blade 14 is attached to the chain saw frame 13 in a conventional manner. Blade 14 has second end 19 which may have end protector 16 attached thereto. Blade 14 has chain 15 extending around its outer periphery, chain 15 being received in a groove in blade 14 in a conventional manner. Guard 28 includes guard bar 31 that is supported above and adjacent the chain 15. Guard bar 31 is swingably attached at its first end 30 adjacent frame 13. Support 23 is attached to first end 17 of blade 14. Support 23 may be made up of first support member 22 and second support member 24. Spaced support members 22,24 are rigidly attached to blade 14 by a suitable bolt 26 forming hinge 20. Guard bar 31 may be made of a steel tube.

Second support 35 may be secured to end protector 16 by means of bolts 37 or other suitable fastener. Second support 35 extends above the chain where it supports flexible clamp members 34,36 in a position to engage guard bar 31 adjacent its second end 32 and releasably secure guard bar 31 in a guard position. When chain saw 10 is not in use, guard bar 31 is swung to the position shown in FIGS. 1 and 2 wherein second or distal end 32 of guard bar 31 is disposed between clamp members 34,36. Each clamp member 34,36 is made of a spring steel material with an end of each clamp member 34,36 fixed to second support 35. Rubber handle 29 is received on distal end 32 of guard bar 31. Rubber handle 29 is of the type familiar to those skilled in the art used on chair legs and the like to protect the floor on which the work rests. It provides an end cover for guard bar 31 and it provides the surface that is bumped against workpiece 46 to release guard bar 31 from and secure guard bar 31 to clamping members 34,36.

When chain saw 10 is in use, guard bar 31 will swing upwardly to allow workpiece 46, which may be tree branch, log or whatever, to pass by as the cut is completed. Guard bar 31 can swing to the position shown in FIG. 3, where guard bar 31 is disposed approximately at a right angle to blade 14 and allows for a useful work area that extends between first support 23 and second support 35.

Figure 4:
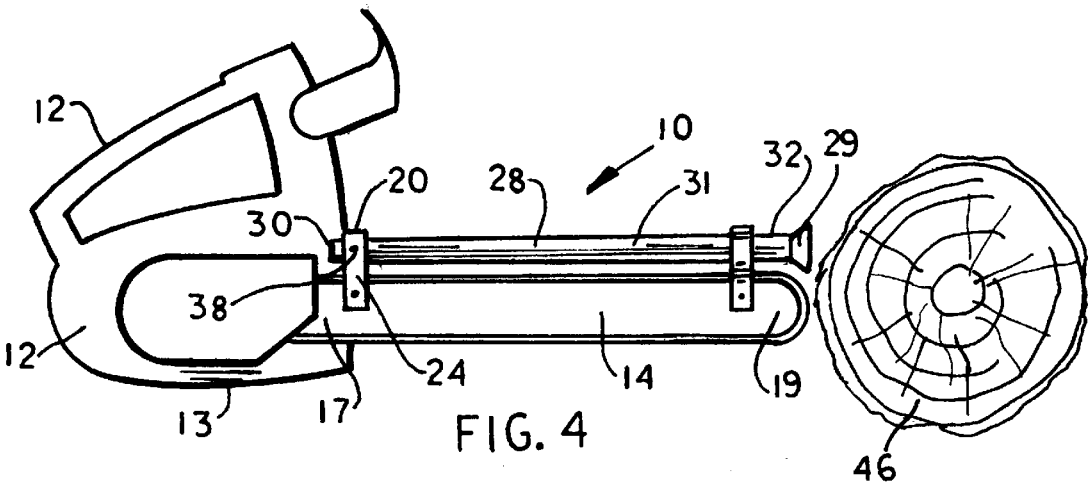
FIG. 4 is a side view of a second embodiment of the invention showing the guard in retained position and being bumped against a work piece to release the guard from the clamp members.
Figure 5:
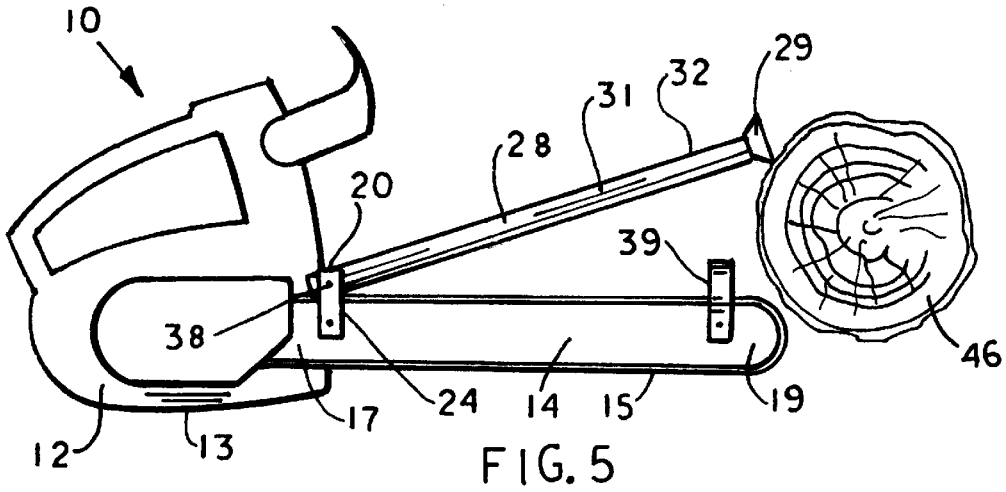
FIG. 5 is a side view of the second embodiment of the invention showing the guard in a position released from the retaining members and ready for use.
Figure 6:
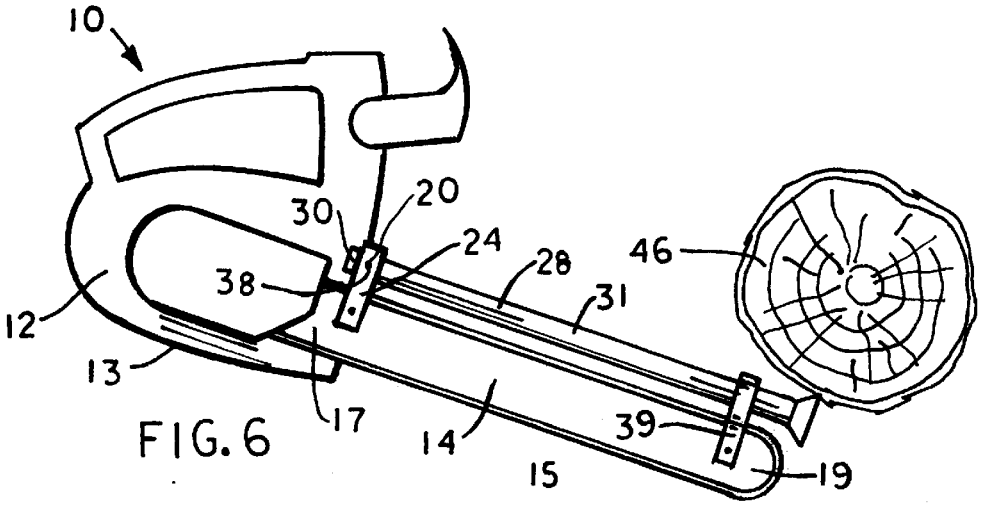
FIG. 6 is a side view of the second embodiment of the invention showing the guard being bumped against a work piece to return the guard to a secured or retained position.
Figure 7:
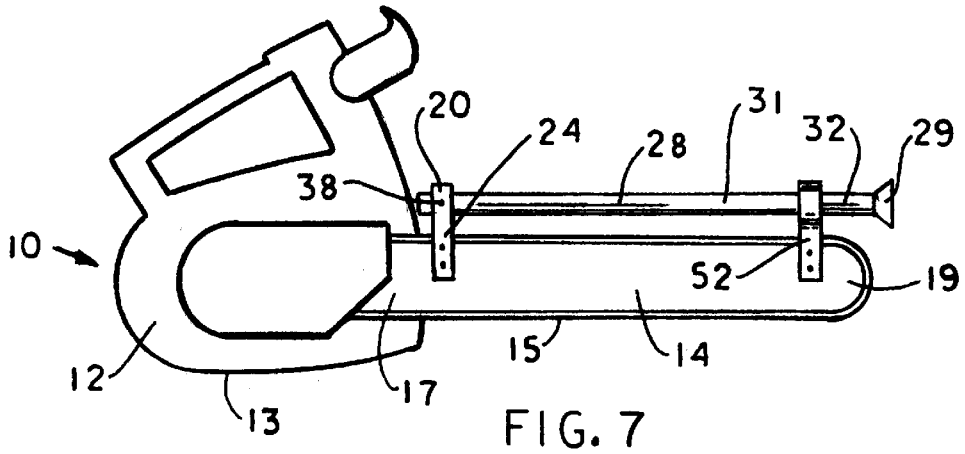
FIG. 7 is a side view of a third embodiment of the invention showing the guard in a retained position secured by the single clamp or retaining member.
Figure 8:
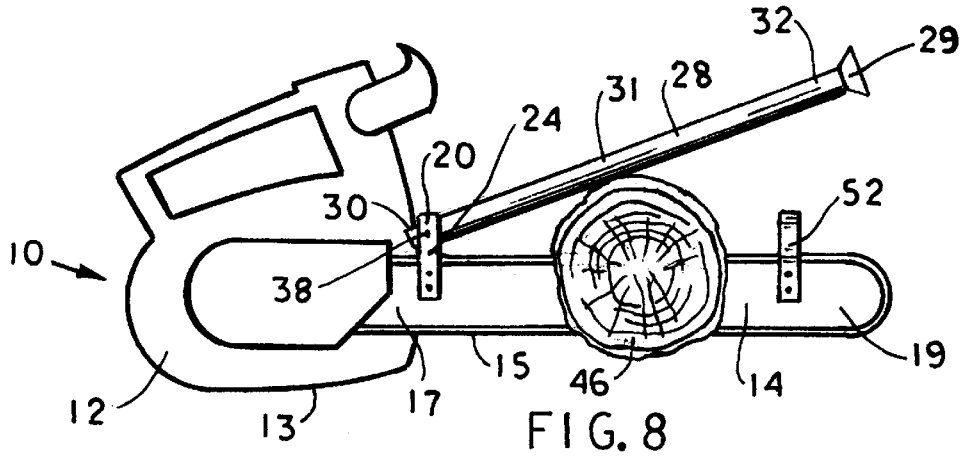
FIG. 8 is a side view of the third embodiment of the invention showing the guard released from the single retaining member and the chain saw is sawing through a work piece with the guard in an operating position.
Figure 9:
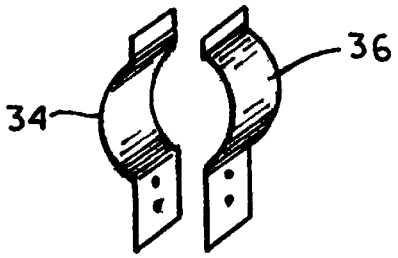
FIG. 9 is a perspective view of the retaining members shaped to retain the guard in a retained position.
Figure 10:
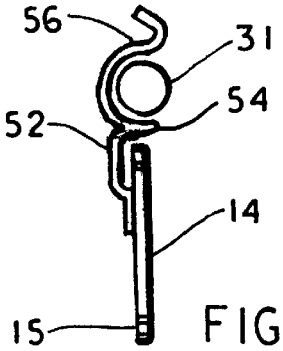
FIG. 10 is an end view of the third embodiment of the invention showing the single retaining member holding the guard in a retained position.
Figure 12:
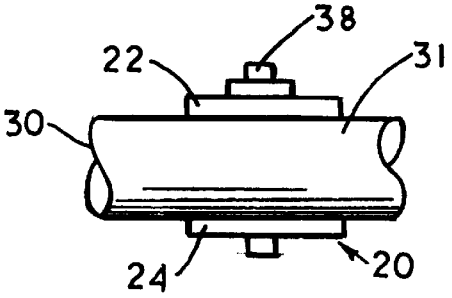
FIG. 12 is a top view of the rotatable attachment of the guard at the proximate end of the chain guide bar.
Figure 11:
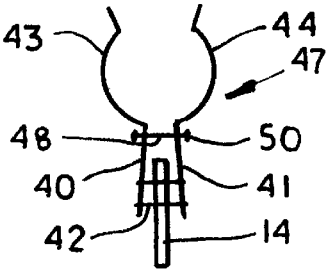
FIG. 11 is an end view of the two retaining member embodiment showing the tension adjusting threaded member.

In another embodiment of the invention as shown in FIGS. 4 through 6, chain saw guard 28 may have first support 23 made up of first support member 22, second support member 24 and bolt 26 extending therethrough to secure first support 23 to the proximal end of chain guide member 14. Bolt 38 through support members 22,24 and guard bar 31 forms hinge 20. Second end 32 of guard bar 31 is releasably secured by clamping means 39 which consists of first spring plate 40 and second spring plate 41 bolted to the distal second end 19 of blade 14 by bolt 42 or other suitable fastener. Distal second end 32 of guard bar 31 swings down between second plates 40,41 and is retained in the shaped first engaging end 43 and second engaging end 44 of the spring plates.

The chain saw guard may also have tension adjusting means 47 on spaced spring plates 40,41. Tension adjusting means 47 may comprise threaded bolt 48 extending between spring plates 40,41 and wing nut 50 which may be tightened or loosened to adjust the force required to insert distal second end 32 of guard bar 31 into a secured position between spring plates 40,41, to store guard bar 31 and to adjust the force required to release guard bar 31 from the secured position between spring plates 40,41 to use the chain saw and guard bar 31.

In another embodiment, single spring plate 52 is secured to distal end 19 of guide bar 31. Upper end 54 of single spring plate 52 has lower portion 54 that extends below and supports guard bar 31 in a guard position, and an upper portion 56 which extends above and releasably restrains guard bar 31 in a guard position.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination, a chain saw and a guard;

said chain saw having a frame, a chain guide fixed to said frame;

a chain supported on said chain guide;

said chain guide being fixed to said frame at a first end and having a second end spaced from said frame;

a hinge fixed adjacent said first end of said chain guide;

a support member is attached adjacent said second end of said chain guide;

said guard having a first end and a second end;

said first end of said guard being swingably attached to said hinge;

said second end of said guard being swingable to a position generally parallel to said chain guide and into supporting relation with said support member for supporting said guard above said chain guide.

2. The combination recited in claim 1 wherein said hinge comprises two spaced hinge members fixed to said chain guide;

said first end of said guard is disposed between said hinge members, and a hinge pin extends through said hinge members and said guard whereby said guard is swingably attached to said chain guide.

3. The combination recited in claim 1 further comprising clamp members at the upper end of said support member;

said clamp members are made of resilient material and shaped to conform to the shape of said guard and receive said guard between said shaped clamp members.

4. The combination recited in claim 1 further comprising a clamp member at the upper end of said support member;

said clamp member being made of resilient material and shaped to conform to the shape of said guard and receive said guard in said shaped clamp member in a guard position.

5. The combination recited in claim 1 wherein said guard is a tubular member and has a handle on said second end.

6. The combination recited in claim 1 wherein said hinge comprises two spaced members having first and second ends;

said spaced members receiving said chain guide therebetween and a first through bolt extending through said first ends of said spaced members and through said chain guide;

said guard being received between said second ends of said spaced members;

a second through bolt comprising a hinge pin swingably supporting said guard on said spaced members whereby said guard may swing from a first portion generally parallel to said chain guide where the guard protects a user, to a second position generally perpendicular to said chain guide to allow a workpiece to pass the guard as the chain saw cuts therethrough.

7. The combination recited in claim 1 wherein said support member further comprises a spring plate having a support portion affixed to said chain guide and extending upwardly therefrom;

said spring plate having a shaped guard retaining portion positioned generally above said chain guide; and, said spring plate terminating in a guard guiding portion.

8. The combination recited in claim 1 wherein said support member further comprises a first spring plate and a second spring plate;

said first spring plate comprising a support portion, a guard retaining portion and a guard guiding portion;

said second spring plate comprising a support portion, a guard retaining portion and a guard guiding portion;

said first and said second spring plates being oppositely disposed and rigidly affixed to said chain guide whereby said spring plates will cooperate to retain said guard.

9. The combination recited in claim 8 wherein a threaded member extends between said spring plates and may be moved to adjust the tension of said spring plates.

10. A chain saw in combination with a guard, said combination comprising:

a chain saw and a guard;

said chain saw having a chain guide;

said chain guide having a first end and a second end;

a hinge is fixed to said first end of said chain guide;

a bracket support is attached to said second end of said chain guide;

said guard having a first end and a second end;

said first end of said guard being swingably attached to said hinge;

said second end of said guard being swingable to a position generally parallel to said chain guide and into supporting relation with said bracket support for holding said guard in parallel relation to said chain guide.

11. The combination recited in claim 10 wherein said hinge comprises two spaced hinge members fixed to said chain guide and said first end of said guard is disposed between said hinge members and a hinge pin extending through said hinge members and said guard whereby said guard is swingably attached to said chain guide.

12. The combination recited in claim 11 wherein said hinge members are shaped to receive said guard.

13. The combination recited in claim 10 wherein said bracket support comprises members made of resilient material and shaped to conform to the shape of said guard and receive said guard between said shaped members.

14. The combination recited in claim 13 wherein said guard is a tubular member and has a handle on said second end and said guard.

15. The combination recited in claim 10 wherein said hinge comprises two spaced plate members receiving said chain guide therebetween and a first through bolt extending through said hinge members clamping said hinge members and through said chain guide;

said guard being received between said hinge members;

a second through bolt comprising a hinge pin swingably supporting said guard on said chain guide to swing from positions generally parallel to said chain guide in a guard position to a position generally perpendicular to said chain guide in an open position.

16. The combination recited in claim 10 wherein said bracket support further comprises a spring plate having a support portion affixed to said chain guide and extending upwardly therefrom;

said spring plate having a shaped guard retaining portion positioned generally above said chain guide; and, said spring plate terminating in a guard guiding portion.

17. The combination recited in claim 10 wherein said bracket support further comprises a first spring plate and a second spring plate;

said first spring plate comprising a support portion, a guard retaining portion and a guard guiding portion;

said second spring plate comprising a support portion, a guard retaining portion and a guard guiding portion;

said first and said second spring plates being oppositely disposed and rigidly affixed to said chain guide whereby said spring plates will cooperate to retain said guard.

18. The combination recited in claim 17 wherein a threaded member extends between said spring plates and may be moved to adjust the tension of said spring plates.

19. A chain saw having a chain on a chain guide and a guard having a first end and a second end;

said first end of said guard being swingably supported above said chain wherein the improvement comprises:

means to releasably secure said second end of said guard supported above said chain.

20. The chain saw recited in claim 19 wherein said releasably securing means comprises a rigid member extending upwardly from and rigidly attached to said chain guide; and, flexible clamping members attached to said rigid member.

* * * * *